US009578902B2

(12) United States Patent
Blackwell

(10) Patent No.: US 9,578,902 B2
(45) **Date of Patent: *Feb. 28, 2017**

(54) POST-OPERATIVE COMPRESSION BRA AND DRAIN APRON

(71) Applicant: Lea M. Blackwell, Fort Myers, FL (US)

(72) Inventor: Lea M. Blackwell, Fort Myers, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/943,560

(22) Filed: Nov. 17, 2015

(65) Prior Publication Data

US 2016/0066624 A1 Mar. 10, 2016

Related U.S. Application Data

(63) Continuation of application No. 14/308,215, filed on Jun. 18, 2014, now Pat. No. 9,277,773.

(51) Int. Cl.

| | |
|---|---|
| ***A41C 3/02*** | (2006.01) |
| ***A41C 3/00*** | (2006.01) |
| *A41D 13/12* | (2006.01) |

(52) U.S. Cl.

CPC ..... *A41C 3/0064* (2013.01); *A41C 3/0035* (2013.01); *A41C 3/02* (2013.01); *A41D 13/1245* (2013.01)

(58) Field of Classification Search

CPC ..... A41C 3/00; A41C 3/148; A41C 3/0064; A41C 3/04; A41C 3/02; A41C 573/005; A41C 573/0028; A41C 573/0021; A41F 1/006; A61F 5/03; A61F 13/145; A41D 1/06; A41D 13/1245

USPC .. 450/26, 28, 71, 79, 72, 73, 36, 37, 86, 89, 450/1, 9, 10, 15, 17, 54–58; 2/104–106, 2/114, 115, 267, 268

See application file for complete search history.

(56) References Cited

U.S. PATENT DOCUMENTS

| | | | | |
|---|---|---|---|---|
| 2,662,522 A | | 12/1953 | Muller | |
| 3,561,442 A | * | 2/1971 | Goswitz | A61F 5/03 128/DIG. 15 |
| 3,698,399 A | * | 10/1972 | Hand | A41C 3/0021 450/59 |
| 3,968,803 A | | 7/1976 | Hyman | |
| 4,369,792 A | * | 1/1983 | Miller | A41C 3/148 450/55 |
| 4,804,351 A | * | 2/1989 | Raml | A41C 3/0064 2/DIG. 1 |
| 4,949,436 A | * | 8/1990 | Anscher | A44B 11/263 24/616 |

(Continued)

*Primary Examiner* — Gloria Hale

(74) *Attorney, Agent, or Firm* — Livingston Loeffler, P.A.; Edward M. Livingston, Esq.; Bryan L. Loeffler, Esq.

(57) ABSTRACT

A post-operative compression bra (1) having an opening located between two portions, a front right portion (2) and a front left portion (3) that are secured together using strap clips (9) that allow pressure being exerted by the bra on a patient to be adjusted. Rounded notches (19) are located on an upper edge (17) of a right side portion (12) and a left side portion (13) to prevent the side portions from coming into contact with a patient's lymph nodes. The side portions and a rear portion (20) may also be partially constructed out of a mesh material to allow for air flow to the skin. A drain apron (30) provides storage for drain bulbs (32).

12 Claims, 3 Drawing Sheets

(56) References Cited

U.S. PATENT DOCUMENTS 5,081,718 A * 1/1992 Carman ..... A41D 1/06 2/227
5,152,741 A * 10/1992 Farnio ..... A41C 3/0064 450/1
5,158,541 A * 10/1992 McCurley ..... A61F 13/145 450/55
5,257,956 A * 11/1993 Ewen ..... A41C 3/148 2/102
5,429,593 A * 7/1995 Matory ..... A61F 13/145 2/114
5,527,270 A * 6/1996 Chase ..... A61F 13/145 450/58
5,839,942 A * 11/1998 Miller ..... A41C 3/04 2/73
5,871,388 A * 2/1999 Lambert ..... A41C 3/02 2/73
6,168,498 B1 * 1/2001 Wagner ..... A41C 3/0057 450/1
6,233,793 B1 * 5/2001 Wanzenbock ..... A41F 1/006 24/614
D446,629 S 8/2001 Swanger
6,390,885 B1 * 5/2002 Brooks ..... A41C 3/0064 450/1
6,755,717 B2 6/2004 Smith
6,793,556 B1 * 9/2004 Fildan ..... A41C 3/02 2/323
6,860,789 B2 * 3/2005 Bell ..... A41C 3/0064 2/102
D503,509 S 4/2005 Bell et al.
6,936,021 B1 * 8/2005 Smith ..... A41D 13/1245 2/114
7,144,294 B2 12/2006 Bell et al.
7,192,409 B2 * 3/2007 Lorenzo ..... A61F 5/03 2/67
7,445,541 B2 * 11/2008 Patterson ..... A41C 3/0064 2/463
7,549,971 B2 6/2009 Bell et al.
7,775,851 B2 * 8/2010 Sgro ..... A41C 3/02 450/1
7,909,675 B1 * 3/2011 Rainey ..... A41C 3/02 450/59
7,922,682 B2 * 4/2011 Bell ..... A41C 3/0064 128/874
8,790,154 B2 * 7/2014 Blackwell ..... A41C 3/0064 450/58
9,277,773 B2 * 3/2016 Blackwell ..... A41C 3/0064
2005/0112996 A1 * 5/2005 Buehler ..... A41F 1/006 450/58
2011/0318990 A1 * 12/2011 Bodnar ..... A41C 3/005 450/58
2013/0171911 A1 * 7/2013 Swendseid ..... A41C 3/0028 450/85
2014/0302748 A1 * 10/2014 Blackwell ..... A41C 3/0064 450/58

* cited by examiner

POST-OPERATIVE COMPRESSION BRA AND DRAIN APRON

FIELD OF THE INVENTION

This invention relates to compression garments and brassieres and, more particularly, a bra for providing compressive forces to a female torso and breasts to help eliminate or reduce swelling normally experienced after breast surgery.

BACKGROUND OF THE INVENTION

Compression bras are used for patients who have undergone breast augmentation or reduction, reconstructive surgery, mastectomies and so forth. Compression bras apply compression on the surface of the patient's skin to reduce the physical volume of the breasts and surrounding areas, thereby reducing the effects of swelling and bruising commonly experienced after surgery. Conventional compression bras typically fasten in the front using a hook and loop fastener that can scratch the skin and fail to provide an easy means for adjusting the amount of pressure exerted on a patient by the bra. An additional problem with the design of conventional compression bras is that a seam is located down the middle of each cup that rubs against the nipple and causes irritation to the patient. An even further problem with conventional bras is the side straps that wrap around the torso press against patients' lymph nodes located under the armpits, an area where incisions are commonly made during breast surgery, thereby causing further discomfort to the patient.

Therefore, a need exists for an ergonomic post-operative compression bra that reduces the effects of swelling and bruising commonly experienced after breast surgery while not causing any discomfort normally experienced with conventional post-operative compression bras.

SUMMARY OF THE INVENTION

The primary object of the present invention is to provide a post-operative compression bra that reduces the effects of swelling and bruising commonly experienced after breast surgery while not causing any discomfort normally experienced with conventional post-operative compression bras.

An additional object of the present invention is to provide a post-operative compression bra that allows a patient or caregiver to easily adjust the amount of pressure exerted on a patient by the bra.

An even further object of the present invention is to provide a post-operative compression bra and drain apron for providing storage areas for carrying drain bulbs that keep the drain bulbs in easy to access and secure positions on a patient's body.

The present invention fulfills the above and other objects by providing a post-operative compression bra having an opening located between a front right portion and a front left portion that are secured together using strap clips that allow the pressure being exerted on a patient to be adjusted. The strap clips and adjustable attachment straps offer ergonomic attachments that can easily be secured by a patient having decreased motor function after breast surgery or other surgeries, such as heart surgery. The strap clips and attachment straps allow a patient or caregiver to tighten or loosen the post-operative compression bra by pulling on a distal end of an attachment strap without separating a right front portion of the strap clip from a left front portion of the strap clip, as would be necessary with conventional bras using hook and loop fastener to secure the bra. In addition, strap clips or maternity bra clasps may be used to secure shoulder straps to the front right portion of the bra and the left front portion of the bra.

Rounded notches may be located on an upper edge of a right side portion and a left side portion to prevent the side portions from coming into contact with a patient's lymph nodes. The side portions and a rear portion may also be partially constructed out of a mesh material to allow for air flow to the skin.

Pockets are located across a right front section and left front section, respectively. The pockets are provided to hold drain bulbs and/or cold packs against the breasts.

A drain apron having a plurality of pockets provides storage for drain bulbs. Drain bulbs are reservoirs connected to a flexible drainage tube sutured into place. Drain bulbs remove fluid from the surgical wound through mild suction. The drain apron is worn around a patient's midsection, inferior to and/or extending downward from a lower edge of the bra. Straps extend from side edges of the drain apron and are wrapped around the patient's midsection and back and secured in front of the patient, so the patient does not have to lay on the attachment. A plurality of loops are located along an upper edge of the drain apron. The straps are threaded though the loops to provide additional support to the drain apron and to prevent the drain apron from sagging under the weight of drain bulbs. Elastic is located along an upper edge of each pocket to prevent the drain bulbs from falling out of the apron, which would cause unwanted pulling on the sutures holding the drain tubes in the surgical wound.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
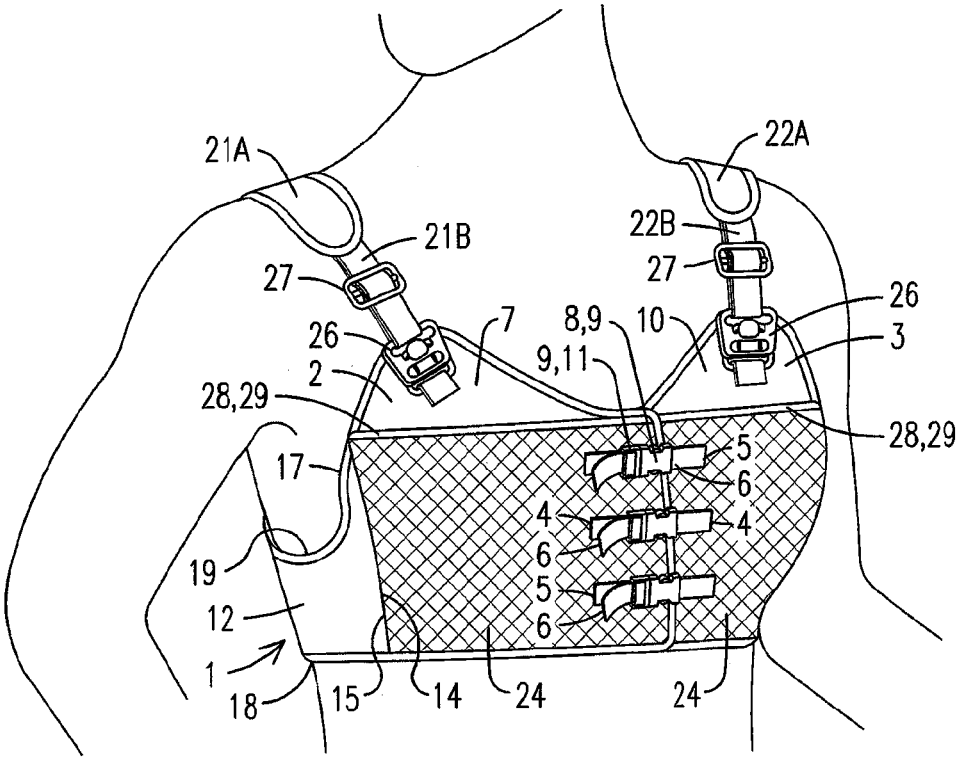
FIG. 1 is a front perspective view of a post-operative compression bra and drain apron of the present invention being worn by a patient.

For purposes of describing the preferred embodiment, the terminology used in reference to the numbered accessories in the drawings is as follows:

1. post operative compression bra
2. front right portion
3. front left portion

Figure 2:
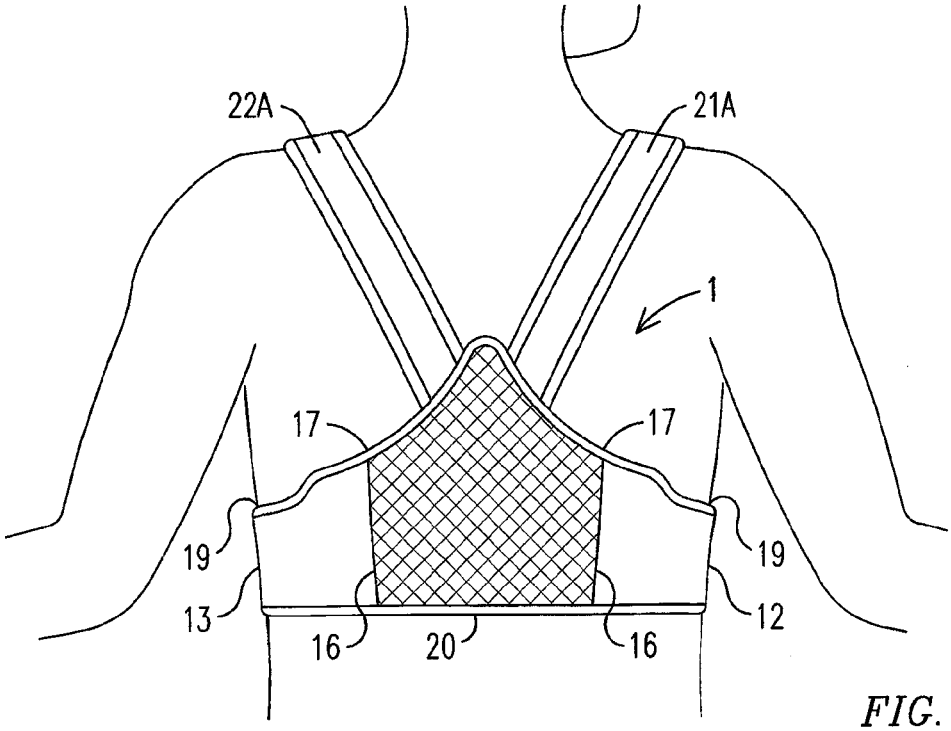
FIG. 2 is a rear view of a post-operative compression bra and drain apron of the present invention being worn by a patient.
Figure 3:
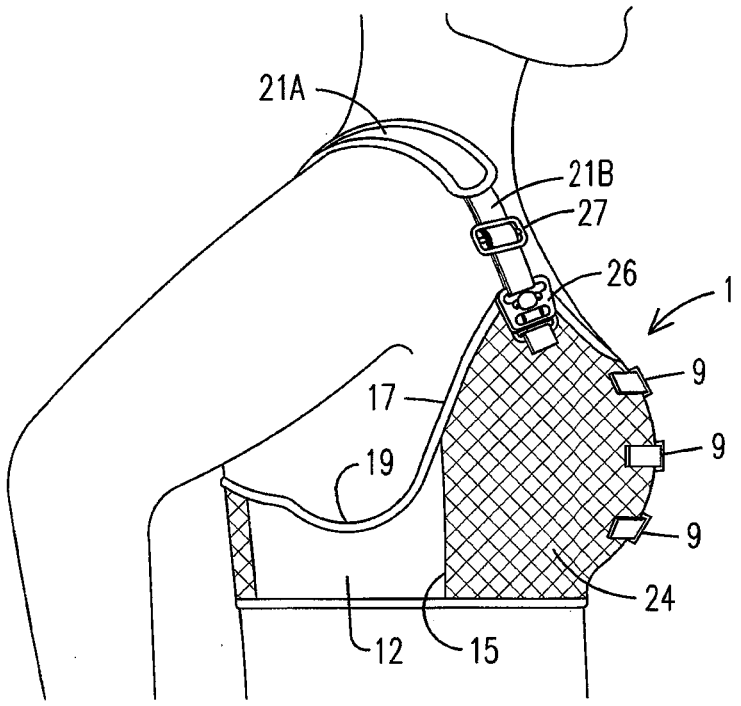
FIG. 3 is a side view of a post-operative compression bra of the present invention having a notch located on a side portion and being worn by a patient.

4. attachment strap
5. proximal end
6. distal end
7. front surface of front right section
8. female portion
9. strap clip
10. front surface of front left section
11. male portion
12. right side portion
13. left side portion
14. outer edge of front portion
15. front edge of side portion
16. rear edge of side portion
17. upper edge of side portion
18. lower edge of side portion
19. notch
20. rear portion
21A. right padded shoulder strap
21B. right adjustable shoulder strap
22A. left padded shoulder strap
22B. left adjustable shoulder strap
23. upper edge of rear portion
24. pocket
25. interior surface
26. maternity clip
27. adjustment clip
28. upper edge of pocket
29. elastic material
30. drain apron
31. pocket
32. drain bulb
33. drain tube
34. lower edge of bra
35. drain apron strap
36. side edge of drain apron
37. attachment means
38. loop
39. upper edge of drain apron
40. main panel of drain apron With reference to FIGS. 1, 2 and 3, a front perspective view of a post-operative compression bra 1 of the present invention being worn by a patient and a rear view of a post-operative compression bra 1 of the present invention being worn by a patient and a side view of a post-operative compression bra 1 of the present invention having a notch 19 a side view of a post-operative compression bra of the present invention having a notch located on a side portion and being worn by a patient located on a side portion and being worn by a patient, respectively, are illustrated. The post-operative compression bra 1 comprises a front right portion 2 and a front left portion 3 that are worn over the patient's breasts. At least one attachment strap 4 having a proximal end 5 and a distal end 6 is attached at the proximal end 6 to a front surface 7 of the front right section 2. A female portion 8 of a strap clip 9 is attached to the distal end 6 of the at least one strap 4 that is attached to the front right portion 2. At least one attachment strap 4 having a proximal end 5 and a distal end 6 is attached at the proximal end 5 to a front surface 10 of the front left portion 3. A male portion 11 of a strap clip 9 is attached to the distal end 6 of the at least one attachment strap 4 that is attached to the front left portion 3. When the front right portion 2 and front left portion 3 are secured together using strap clips 9 a portion of the front left portion 3 rests under a portion of the right front portion 2 to separate the patient's skin from the strap clips 9 and to provide extra cushioning between the patient's skin and the strap clips 9. The strap clips 9 also allow a patient or caregiver to tighten or loosen the post-operative compression bra 1 by pulling on the distal end 6 of the at least one attachment strap 4 without separating the right front portion 2 from the left front portion 3, as would be necessary with conventional bras using hook and loop fastener as an attachment means.

A right side portion 12 and a left side portion 13 extend from an outer edge 14 of the right front portion 2 and the left front portion 3, respectively, around sides of the patient's torso. The side portions 12, 13 each comprise a front edge 15, rear edge 16, upper edge 17 and lower edge 18. The upper edges 17 of each side portion 12, 13 curves downward toward the lower edges to create substantially C-shaped notches 19, thereby preventing the side portions 12, 13 from coming into contact with a patient's lymph nodes.

A rear portion 20 is located between the rear edges 16 of the side portions 12, 13. The rear portion 20 may be made of a cloth material and/or breathable mesh material that allow airflow to the patient's skin. The rear portion 20 is preferably substantially triangular-shaped and constructed from a mesh material to provide air flow. A right padded shoulder strap 21A and left padded shoulder strap 22A extend from an upper edge 23 of the rear portion 20 over the patient's shoulders. The right padded shoulder strap 21A and the left padded shoulder strap 22A are preferably attached to the front right portion 2 and front left portion 3, respectively, by maternity clips 9 and adjustable shoulder straps 21B, 22B that allow the padded shoulder straps 21, 22 to easily be attached and detached from the front portions 2, 3. A patient and/or caregiver may adjust the length of the shoulder straps 21, 22 using adjustment clips 27. Pockets 24 are located across the right front section 2 and left front section 3, respectively. The pockets 24 are provided to hold drain bulbs and/or cold packs against the breasts and are preferably constructed from mesh to view the contents of the pockets 24. Upper edges 28 of the pockets 24 may be constructed out of an elastic material 29 to prevent contents in the pockets 24 from falling out.

Figure 4:
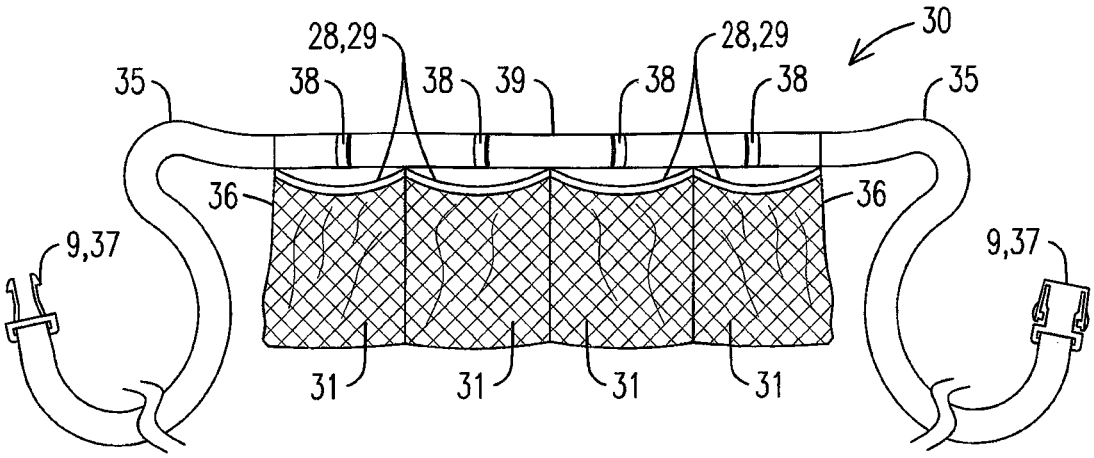
FIG. 4 is a front view of a drain apron of the present invention.
Figure 5:
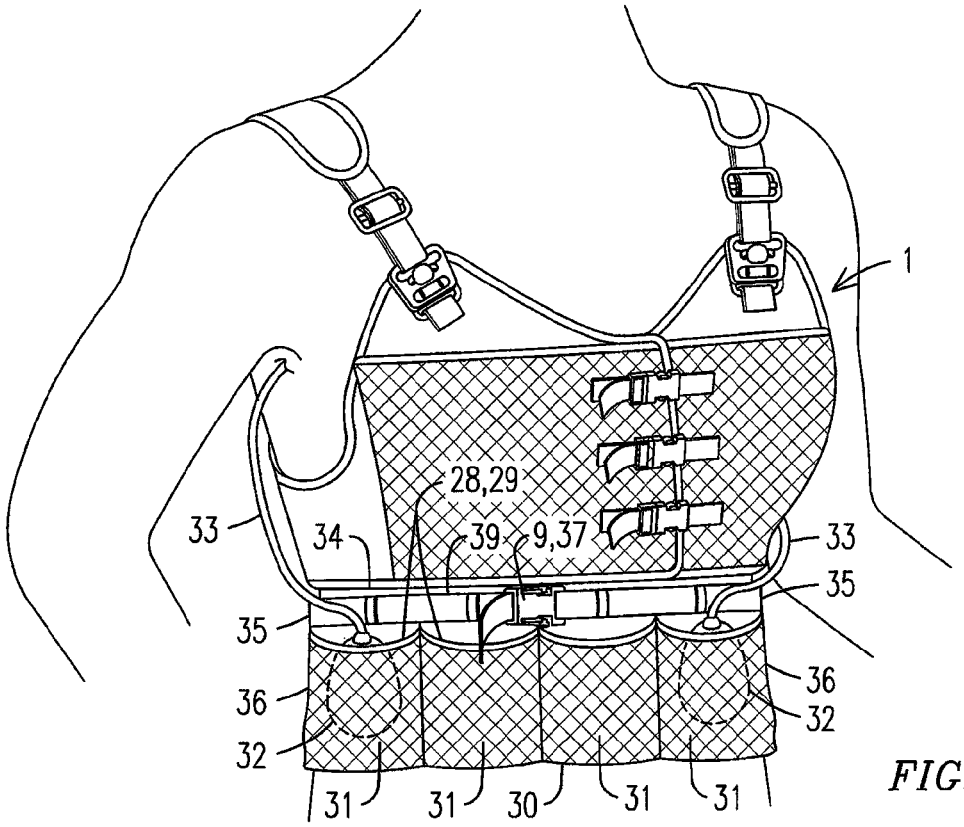
FIG. 5 is a front perspective view of a post-operative compression bra and drain apron of the present invention being worn by a patient.
Figure 6:
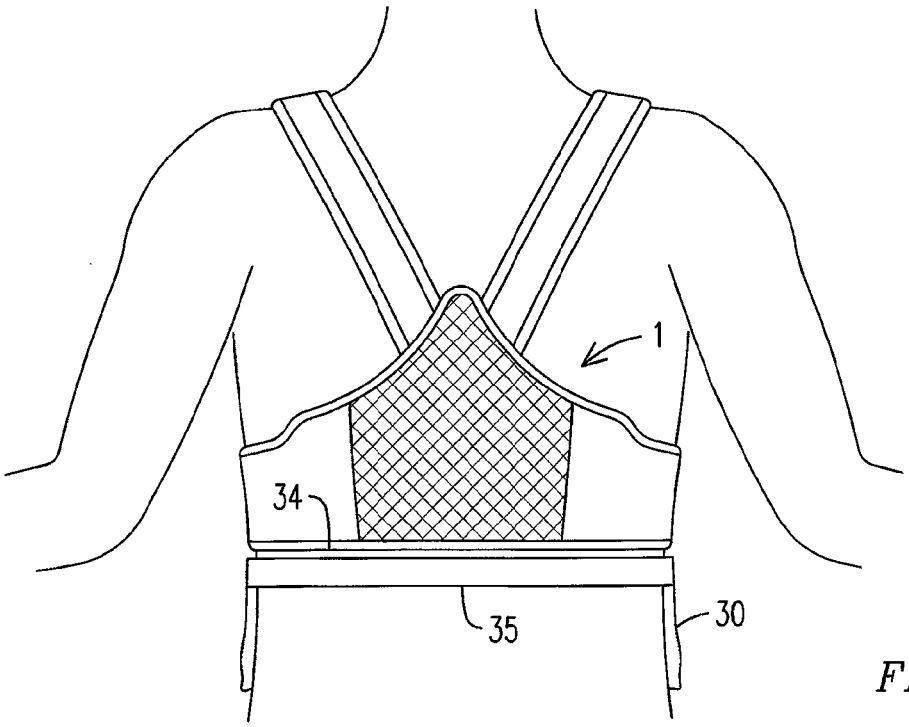
FIG. 6 is a rear view of a post-operative compression bra and drain apron of the present invention being worn by a patient.

With reference to FIGS. 4-6, a front view of a drain apron 30 of the present invention, a front perspective view of a post-operative compression bra 1 and drain apron 30 of the present invention being worn by a patient and a rear view of a post-operative compression bra 1 and drain apron 30 of the present invention being worn by a patient, respectively, are illustrated. The drain apron 30 comprises a plurality of pockets 31 located on a main panel 40 for providing storage for drain bulbs 32. Drain bulbs 32 are reservoirs connected to a flexible drainage tube 33 sutured into place. Drain bulbs 32 remove fluid from the surgical wound through mild suction. The drain apron 30 is worn around a patient's midsection, inferior to and/or extending downward from a lower edge 34 of the bra 1 either separately, removably attachable or integral to the bra 1. Straps 35 extend from side edges 36 of the drain apron 30 and are wrapped around the patient's midsection and back and secured in front of the patient, so the patient does not have to lay on an attachment means 37, such as a strap clip 9, a knot, hook and loop fastener and so forth. A plurality of loops 38 are located proximate to an upper edge 39 of the drain apron 30. The straps 35 are threaded though the loops 38 to provide additional support to the drain apron 30 and to prevent the drain apron 30 from sagging under the weight of drain bulbs 32. Elastic 29 is located along an upper edge 33 of each pocket 31 to prevent the drain bulbs 32 from falling out of the drain apron 30, which would cause unwanted pulling on the sutures holding the drain tubes 33 in the surgical wound.

The pockets 31 are preferably constructed from mesh to view the contents of the pockets 31.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A post-operative bra for reducing the effects of swelling and bruising commonly experienced after breast surgery, said post-operative bra comprising:

a front right portion worn over a patient's right breast and attached to a right side portion;

said right side portion extending around a right side of a patient's torso and being attached to a rear portion that extends across a back of the patient;

a front left portion worn over a patient's left breast and attached to a left side portion;

said left portion extending around a left side of a patient's torso and being attached to said rear portion;

a plurality of attachment straps each adjustably attached to the post-operative bra and to a respective strap clip from a plurality of strap clips so that when a distal end of each attachment strap is pulled, a circumference of said post-operative bra is reduced, thereby compressing the front right portion and the left front portion against the right breast and left breast, respectively, of the patient;

each of the plurality of attachment straps attached to the front right portion of the bra and the front left portion of the bra in a horizontal position and all positioned in a vertically stacked position in relation to each other on the front right portion of the bra and the front left portion; and said plurality of strap clips each having a male portion and a female portion wherein said male portion having at least two prongs that are inserted into said female portion to secure said male portion to said female portion to secure the front right portion to the front left portion, thereby securing the bra on the patient.

2. The post-operative bra of claim 1 further comprising:

a pocket located across the right front section of the post-operative bra; and a pocket located across the left front section of the post-operative bra.

3. The post-operative bra of claim 1 further comprising:

a substantially C-shaped notch located on an upper edge of the right side portion and having a midway point aligned with a mid-axillary line of a wearer; and a substantially C-shaped notch located on an upper edge of the left side portion and having a midway point aligned with a mid-axillary line of a wearer.

4. The post-operative bra of claim 1 further comprising:

a right shoulder strap extending from an upper edge of the rear portion to the front right portion; and a left shoulder strap extending from the upper edge of the rear portion to the front left portion.

5. The post-operative bra of claim 4 wherein:

said right shoulder strap is attachable to said front right portion via at least one strap clip having a male portion and a female portion; and said left shoulder strap is attachable to said front left portion via at least one strap clip having a male portion and a female portion.

6. A post-operative bra for reducing the effects of swelling and bruising commonly experienced after breast surgery, said post-operative bra comprising:

a front right portion worn over a patient's right breast and attached to a right side portion;

said right side portion extending around a right side of a patient's torso and being attached to a rear portion that extends across a back of the patient;

a front left portion worn over a patient's left breast and attached to a left side portion;

said left side portion extending around a left side of a patient's torso and being attached to said rear portion;

a plurality of attachment straps each adjustably attached to the post-operative bra and to a respective strap clip from a plurality of strap clips so that when a distal end of each attachment strap is pulled, a circumference of said post-operative bra is reduced, thereby compressing the front right portion and the left front portion against the right breast and left breast, respectively, of the patient;

each of the plurality of attachment straps attached to the front right portion of the bra and the front left portion of the bra in a horizontal position and all positioned in a vertically stacked position in relation to each other on the front right portion of the bra and the front left portion; and said plurality of strap clips each having a male portion and a female portion wherein said male portion having at least two prongs that are inserted into said female portion to secure said male portion to said female portion to secure the front right portion to the front left portion, thereby securing the bra on the patient;

a right shoulder strap extending from an upper edge of the rear portion to the front right portion; and a left shoulder strap extending from the upper edge of the rear portion to the front left portion.

7. The post-operative bra of claim 6 further comprising:

a pocket located across the right front section of the post-operative bra; and a pocket located across the left front section of the post-operative bra.

8. The post-operative bra of claim 6 further comprising:

a substantially C-shaped notch located on an upper edge of the right side portion and having a midway point aligned with a mid-axillary line of a wearer; and a substantially C-shaped notch located on an upper edge of the left side portion and having a midway point aligned with a mid-axillary line of a wearer.

9. The post-operative bra of claim 6 wherein:

said right shoulder strap is attachable to said front right portion via at least one strap clip having a male portion and a female portion; and said left shoulder strap is attachable to said front left portion via at least one strap clip having a male portion and a female portion.

10. A post-operative bra for reducing the effects of swelling and bruising commonly experienced after breast surgery, said post-operative bra comprising:

a front right portion worn over a patient's right breast and attached to a right side portion;

said right side portion extending around a right side of a patient's torso and being attached to a rear portion that extends across a back of the patient;

a front left portion worn over a patient's left breast and attached to a left side portion;

said left side portion extending around a left side of a patient's torso and being attached to said rear portion;

a plurality of attachment straps each adjustably attached to the post-operative bra and to a respective strap clip from a plurality of strap clips so that when a distal end of each attachment strap is pulled, a circumference of said post-operative compression bra is reduced, thereby compressing the front right portion and the left front portion against the right breast and left breast, respectively, of the patient;

each of the plurality of attachment straps attached to the front right portion of the bra and the front left portion of the bra in a horizontal position and all positioned in a vertically stacked position in relation to each other on the front right portion of the bra and the front left portion; and said plurality of strap clips each having a male portion and a female portion wherein said male portion having at least two prongs that are inserted into said female portion to secure said male portion to said female portion to secure the front right portion to the front left portion, thereby securing the bra on the patient;

a right shoulder strap extending from an upper edge of the rear portion to the front right portion;

a left shoulder strap extending from the upper edge of the rear portion to the front left portion;

said right shoulder strap is attachable to said front right portion via at least one strap clip having a male portion and a female portion; and said left shoulder strap is attachable to said front left portion via at least one strap clip having a male portion and a female portion.

11. The post-operative bra of claim 10 further comprising:

a pocket located across the right front section of the post-operative bra; and a pocket located across the left front section of the post-operative bra.

12. The post-operative bra of claim 10 further comprising:

a substantially C-shaped notch located on an upper edge of the right side portion and having a midway point aligned with a mid-axillary line of a wearer; and a substantially C-shaped notch located on an upper edge of the left side portion and having a midway point aligned with a mid-axillary line of a wearer.

* * * * *